US011512700B2

(12) United States Patent
Shenoi

(10) Patent No.: US 11,512,700 B2
(45) Date of Patent: Nov. 29, 2022

(54) LOW PRESSURE SEALING LIQUID ENTRY AREA IN A COMPRESSOR TYPE LIQUID RING PUMP

(71) Applicant: GARDNER DENVER NASH LLC, Trumbull, CT (US)

(72) Inventor: Ramesh Balkunge Shenoi, Orangeburg, NY (US)

(73) Assignee: GARDNER DENVER NASH LLC, Trumbull, CT (US)

( * ) Notice: Subject to any disclaimer, the term of this patent is extended or adjusted under 35 U.S.C. 154(b) by 1184 days.

(21) Appl. No.: 14/991,082

(22) Filed: Jan. 8, 2016

(65) Prior Publication Data

US 2016/0201672 A1 Jul. 14, 2016

Related U.S. Application Data

(60) Provisional application No. 62/101,130, filed on Jan. 8, 2015.

(51) Int. Cl.

| | |
|---|---|
| ***F04C 19/00*** | (2006.01) |
| ***F04C 28/06*** | (2006.01) |
| ***F04C 27/02*** | (2006.01) |

(52) U.S. Cl.

CPC ..... *F04C 28/06* (2013.01); *F04C 19/00* (2013.01); *F04C 19/004* (2013.01); (Continued)

(58) Field of Classification Search

CPC ..... F04C 27/02; F04C 19/00–08; F04C 28/06

See application file for complete search history.

(56) References Cited

U.S. PATENT DOCUMENTS 1,662,250 A * 3/1928 Jennings ..... F04C 19/004 417/54

2,195,174 A * 3/1940 Jennings ..... F04C 19/004 417/434

(Continued)

FOREIGN PATENT DOCUMENTS

CN 202187930 U * 4/2012

DE 689345 3/1940

(Continued)

OTHER PUBLICATIONS

Installing Liquid-Ring Vacuum Pumps, by Aglitz et al., published 1996.*

(Continued)

*Primary Examiner* — Thomas Fink

(74) *Attorney, Agent, or Firm* — Edell, Shapiro & Finnan, LLC

(57) ABSTRACT

A liquid ring pump includes a housing, a pump head coupled to the housing and defining an inlet channel, an outlet space, and a cone seal area, and an intake valve movable to control the quantity of a gas entering the inlet channel. A reservoir contains a quantity of sealing liquid, a pump discharge path provides fluid communication between the outlet space and the reservoir, and a first flow member includes a first valve coupled to the reservoir and the inlet channel. A second flow member includes a second valve coupled to the reservoir and the cone seal area, and a rotor is supported for rotation by a shaft. The pump is operable in a start-up mode to draw sealing liquid into the working space via only the first flow member and during a running mode to draw sealing liquid into the working space via only the second flow member.

20 Claims, 2 Drawing Sheets

(52) U.S. Cl.
CPC ..... *F04C 19/005* (2013.01); *F04C 19/008* (2013.01); *F04C 27/02* (2013.01)

(56) References Cited

U.S. PATENT DOCUMENTS 2,195,375 A * 3/1940 Adams ..... F04C 19/004 417/54
3,289,918 A * 12/1966 Adams ..... F04C 19/004 417/228
3,315,879 A * 4/1967 Jennings ..... F01B 25/00 417/250
3,366,061 A * 1/1968 Adams ..... A47J 27/14 137/154
3,575,532 A * 4/1971 Mugele ..... F04C 19/005 417/69
3,642,384 A * 2/1972 Huse ..... F04C 18/126 417/205
3,721,508 A * 3/1973 Mugele ..... F04C 19/005 417/68
3,973,879 A * 8/1976 Ramm ..... F04C 19/004 417/69
3,994,074 A * 11/1976 Lowther ..... B01D 53/26 95/194
4,087,208 A * 5/1978 Uda ..... F04C 19/001 417/54
4,359,313 A * 11/1982 Bernard ..... F04C 19/004 165/101
4,484,457 A * 11/1984 Mugele ..... F04C 23/005 417/69
4,498,844 A * 2/1985 Bissell ..... F04C 19/008 417/68
4,634,348 A * 1/1987 Auschrat ..... F04C 29/122 417/68
4,679,987 A 7/1987 Olsen
4,755,107 A * 7/1988 Trimborn ..... F04C 19/007 417/68
4,921,709 A * 5/1990 Sole ..... A23L 2/02 426/330.5
5,115,157 A * 5/1992 Blumenau ..... F04C 27/02 310/11
5,122,035 A * 6/1992 Juhola ..... F04C 19/002 417/68
5,356,268 A * 10/1994 Lengyel ..... F04C 19/008 417/68
5,366,348 A * 11/1994 Skelton ..... F04C 19/004 417/244
5,456,827 A * 10/1995 Nikutta ..... B01D 61/362 210/167.32
5,511,953 A * 4/1996 Holzheimer ..... F04C 19/001 417/68
5,976,722 A * 11/1999 Muller ..... H01M 8/04119 429/437
6,227,222 B1 5/2001 Jennings
6,558,131 B1 * 5/2003 Nash, Jr. ..... F04C 19/004 417/53
8,366,883 B2 * 2/2013 Bednarek ..... B01D 1/221 203/1
2004/0003593 A1 * 1/2004 Sauer ..... F01K 9/02 60/670
2005/0016828 A1 * 1/2005 Bednarek ..... B01D 1/221 203/1
2005/0155493 A1 * 7/2005 Dean ..... B01D 19/0052 96/214
2012/0076671 A1 3/2012 Bissell et al.
2015/0044016 A1 * 2/2015 Mueller ..... F04D 9/02 415/1
2015/0361979 A1 * 12/2015 Kosters ..... F04C 19/004 417/54
2016/0238008 A1 * 8/2016 Bissell ..... F04C 29/12

FOREIGN PATENT DOCUMENTS

DE 4429907 2/1996
GB 1011451 A 12/1965
JP 2002332978 A 11/2002
JP 2013213425 A 10/2013

OTHER PUBLICATIONS

Dekker Vacuum Technologies, Inc. Installation Operation and Maintenance Manual, published 2006.*
NES Company, Liquid Ring Vacuum Pump Startup & Troubleshooting, published Oct. 2014.*
How to Control Liquid Ring Vacuum Pumps, by Joe Aliasso, published 2002.*
Liquid Ring Technology Increases Production in Low-Pressure Natural Gas Wells, by Dardis, published 2014, URL: http://www.upstreampumping.com/article/production/2014/liquid-ring-technology-increases-production-low-pressure-natural-gas-wells.*
Cone Ported vs Flat Sided Liquid Ring Vacuum Pumps, by Dane, published Jul. 23, 2015, URL: https://www.somarakis.com/cone_ported_vs_flat_sided_liquid_ring_vacuum_pumps/.*
PCT International Search Report and Written Opinion for Application No. PCT/US16/12601 dated Mar. 21, 2016 (16 pages).
Travaini Pumps USA, "Operating & maintenance manual for liquid ring vacuum pumps, compressors & systems", operating manual, Apr. 2002, pp. 1-44, Travaini Pumps USA, Yorktown, VA USA, http://www.glauber.com/files/pdf/pp_maint_manual_lig_ring.pdf; col. 3, section 4 .2; col. 17, section 9.8; col. 24, table 8.
European Patent Office Search Report for Application No. 16735455 dated Nov. 9, 2018 (11 pages).
Japanese Patent Office Action for Application No. 2017-535759 dated Jan. 28, 2019 (11 pages, English translation included).

* cited by examiner

LOW PRESSURE SEALING LIQUID ENTRY AREA IN A COMPRESSOR TYPE LIQUID RING PUMP

BACKGROUND

The disclosure concerns compressor type liquid ring pumps having a sealing liquid introduction path.

Liquid ring pumps and their operation are well known. In general liquid ring pumps utilize a liquid ring which, during operation, delimits a pumping chamber. The ring is eccentric to an axis of a shaft. The shaft rotates a rotor. A radial inward surface of the liquid ring is radially spaced from the shaft at an intake zone to allow buckets formed by adjacent blades of the rotor to fill with gas entering the pump's working chamber through an inlet port. The inlet port is downstream of a pump head inlet. The buckets fill with gas as they sweep past the inlet port. The inlet port can be in a member extending into an orifice formed by the rotor blades or it can be in a port plate.

The radial inward surface of the liquid ring in a compression zone is oriented relative to the shaft to compress the gas in the buckets and force the gas through an outlet port which leads into an outlet of the pump. The ring compresses the gas in the buckets because of its eccentric orientation relative to the shaft. The orientation means the radially inward surface of the liquid ring has a much closer approach to the axis of the shaft in the radial direction along the compression zone as compared to its approach along the intake zone. U.S. Pat. No. 4,498,844, Bissell provides a comprehensive description of how a liquid ring pump operates and some of its basic structure.

Liquid ring pumps include a category of pumps known as compressor type liquid ring pumps. These pumps include a sealing liquid flow path along which sealing liquid flows into the head and working chamber of the pump. The sealing liquid, in part, seals interstices to prevent leakage of gas through the interstices. For instance, the sealing liquid is needed to seal the interstices between the shaft and a conical port member which has the inlet port opening into the working chamber. The sealing liquid flow path is oriented relative to the working chamber and other features and areas of the pump to ensure the sealing liquid enters the working chamber outside of the inlet channel in the pump head which opens into the inlet port. The flow path is also oriented to ensure the sealing liquid enters the working chamber outside of the void space formed by the buckets and the liquid ring in the intake zone of the working chamber. Keeping the sealing liquid from entering these areas and outside of these areas prevents the sealing liquid, an incompressible fluid, from occupying space in these areas and displacing intake gas. Thus the supply of the sealing liquid outside of these areas ensures the sealing liquid does not displace void spaces fillable by the intake gas.

In a known system, during startup, an entry area from which sealing liquid travels to enter into interstices to be sealed by the sealing liquid is at a pressure near to that of the sealing liquid along a flow path which is distal and upstream of the entry area. The entry area can be at the cone seal area. To create a sufficient pressure difference, to flow sealing liquid into the entry area along a portion of the sealing liquid flow path proximate the entry area, an extra pump in fluid connection with the flow path and upstream of the entry area is used. The pump puts the sealing liquid upstream of the entry at a sufficiently higher pressure at start-up than the pressure at the entry. The higher pressure forces the sealing liquid into the interstices. After start-up, the pressure at the pump discharge increases. The flow path, distal of the entry area is in flow connection with the pump discharge and downstream of the pump discharge. Thus the sealing liquid in the portion of the flow path distal to the entry is at the discharge pressure. Therefore, the sealing liquid at discharge pressure forces sealing liquid along the proximate portion of the flow path into the entry area and into the interstices during the running mode.

SUMMARY

One example of the invention is embodied in a compressor type liquid ring pump package. The compressor type liquid ring pump package provides for the flow of the sealing liquid into the interstices to be sealed by the sealing liquid at start-up without an extra pump. The compressor type liquid ring pump package comprises a sealing liquid flow path in fluid connection with a pump discharge outlet of the pump package and downstream of the pump discharge outlet. A portion of the sealing liquid flow path is proximate an entry area. The proximate portion is in fluid connection with the entry area and upstream of the entry area. The entry area can be considered part of the sealing liquid flow path. The entry area preferably comprises a portion of the inlet channel in the pump head of the pump package. The sealing liquid flow path can be called a sealing liquid introduction path.

During start-up, the pressure Pi at the entry area is sufficiently less than the pressure Pd of the sealing liquid along a portion of the sealing liquid flow path distal the entry area. The distal portion is proximate a sealing liquid supply from which the sealing liquid flow path receives sealing liquid. The distal portion of the sealing liquid flow path is upstream of the proximate portion. The sufficient pressure difference exists during start-up without the extra pump and is created by operation of the pump rotor without the extra pump. The pressure at the entry area is near or at zero during startup. The sufficient pressure difference means that a sufficient volume of the sealing liquid upstream of the entry area will flow along the flow path into the entry area during start-up. The sufficient volume is a volume which fills the interstices and otherwise allows for proper operation of the pump. Other aspects of the invention will become apparent by consideration of the detailed description and accompanying drawings.

In one construction, a method of starting a liquid ring pump arranged to compress a gas includes providing a quantity of sealing liquid in a reservoir, the reservoir and a pump head inlet channel being at the same pressure prior to starting the compressor. The method also includes providing a first fluid connection between the pump head inlet channel and the reservoir, moving an intake valve toward a closed positioned at a gas entry opening of the pump head inlet channel to limit the quantity of gas that can pass through the valve to a first quantity, and producing a partial vacuum in the pump head inlet channel by initiating the start sequence for the liquid ring pump. The liquid ring pump is initially operable to pump more than the first quantity of gas. The method further includes drawing fluid from the reservoir via the first fluid connection in response to the pressure differential.

In another construction, a compressor type liquid ring pump that includes a housing defining an interior working space sized to receive a quantity of gas and a quantity of sealing liquid, a pump head coupled to the housing and defining an inlet channel, an outlet space, and a cone seal area, and an intake valve movable between an opened position and a closed position to control the quantity of a gas entering the inlet channel. A reservoir contains a quantity of sealing liquid, a first flow member includes a first valve coupled to the reservoir and the inlet channel to provide fluid communication therebetween, and a second flow member includes a second valve coupled to the reservoir and the cone seal area to provide fluid communication therebetween. A rotor is supported for rotation by a shaft, the rotor disposed at least partially within the working space and operable to draw in the gas from the inlet channel at an inlet pressure and to discharge the gas to the outlet space at an outlet pressure that is higher than the inlet pressure. During a start-up mode the intake valve is moved toward the closed position, the first valve is opened and the second valve is closed, and during a running mode following the start-up mode, the intake valve is moved toward the open position, the first valve is closed and the second valve is opened.

In still another construction, a compressor type liquid ring pump includes a housing defining an interior working space sized to receive a quantity of gas and a quantity of sealing liquid, a pump head coupled to the housing and defining an inlet channel, an outlet space, and a cone seal area, and an intake valve movable between an opened position and a closed position to control the quantity of a gas entering the inlet channel. A reservoir contains a quantity of sealing liquid, a pump discharge path provides fluid communication between the outlet space and the reservoir, and a first flow member includes a first valve coupled to the reservoir and the inlet channel to provide fluid communication therebetween. A second flow member includes a second valve coupled to the reservoir and the cone seal area to provide fluid communication therebetween and a rotor is supported for rotation by a shaft, the rotor disposed at least partially within the working space, the pump operable in a start-up mode to draw sealing liquid into the working space via only the first flow member and during a running mode following the start-up mode to draw sealing liquid into the working space via only the second flow member.

In still another construction, a method of providing sealing liquid to a liquid ring pump that is operable in a start-up mode and a normal mode includes providing a reservoir containing a quantity of sealing liquid, a pump head inlet channel, and an outlet space each at atmospheric pressure prior to initiating operation in the start-up mode. The method also includes initiating the start-up mode, throttling a flow of gas into the inlet channel to produce a low pressure region therein during start-up mode operation, and drawing sealing liquid into the inlet channel through a first flow path in response to the low pressure region in the inlet channel. The method further includes increasing the pressure within the outlet space and the reservoir in response to operation in start-up mode, reducing the throttling of the flow of gas into the inlet channel to transition to normal mode, closing a valve in the first flow path to prevent the flow of sealing liquid into the inlet channel, and opening a valve in a second flow path to direct sealing liquid into the pump in response to the increased pressure within the reservoir.

DETAILED DESCRIPTION

Figure 1:
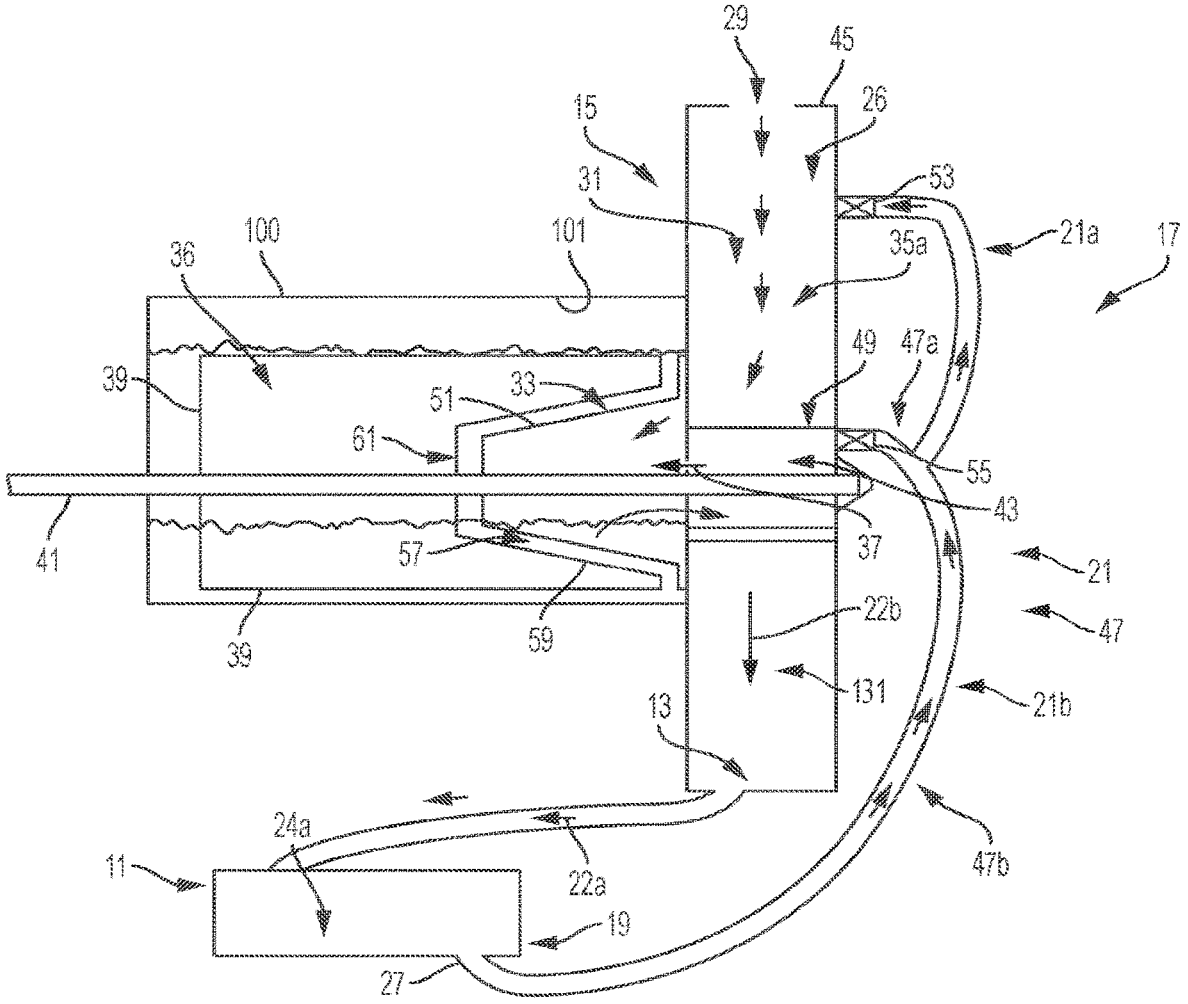
FIG. 1 is a schematic representational section of a liquid ring pump package embodying features of the present invention.

In an example of the present invention, a liquid/gas separator 11 is in fluid connection with and downstream of a pump discharge outlet 13, which is disposed at a downstream end of an outlet space 131 in a pump head 15 of a compressor type liquid ring pump package 17. A sealing liquid reservoir 19 is in fluid connection with and downstream of the liquid/gas separator 11. A sealing liquid flow path 21 is in fluid connection with the sealing liquid reservoir 19, separator 11, and pump discharge outlet 13. The sealing liquid flow path 21 is downstream of each of these items. The term downstream and upstream as used herein is relative to a flow direction. Thus, if A is upstream of B than there is a fluid connection between A and B and the flow direction of the fluid connection is from A to B.

When the compressor type liquid ring pump package 17 is in operation, the separator 11, in a discharge flow direction and along a discharge fluid path 22*a* receives a mixture 22*b* of gas and liquid from the pump discharge outlet 13. The separator 11 separates the liquid from the gas. Along a collecting flow direction and a collecting flow path 24*a*, the separated liquid collects in the reservoir 19. The reservoir can be called a sealing liquid supply.

The sealing liquid flow path 21 places the separated liquid in the reservoir 19 and any outside liquid added to the reservoir in fluid connection with an entry area 26. A portion 21*a* of the sealing liquid flow path 21 is proximate the entry area 24 and in fluid connection with the entry area 26. The entry area is downstream of the proximate portion 21*a* of the sealing liquid flow path 21. The proximate portion 21*a* is in fluid connection with the reservoir 19 but is closer to the entry area 26 than it is to the reservoir 19 and also to a structure 27 connecting the reservoir 19 and the sealing liquid path 21. The distance is measured along the sealing liquid flow path 21. A portion of the sealing liquid flow path 21*b* is distal the entry area 26 compared to the proximate portion 21*a*. The distal portion is upstream of the proximate portion and in fluid connection therewith. The structure 27 connects the distal portion 21*b* to the reservoir 19. The distal portion 21*b* is closer to the reservoir 19, measured along the sealing liquid flow path, than the proximate portion 21*a*. The distal portion 21*b* connects the proximate portion 21*a* to the sealing liquid supply.

The entry area 26 can be considered a portion of the sealing liquid flow path 21. The entry area 26 preferably comprises a space. The space is preferably in a portion of the pump head 15. The space is preferably downstream of a gas entry 29 opening into an inlet channel 31 in the pump head 15 and upstream of an inlet port 33 opening into a working chamber 36 (also referred to as interior working space 36) of the pump package 17. The gas entry 29, inlet channel 31, and inlet port 33 are in fluid connection with each other. The gas travels in a flow direction along a gas flow path 35*a* from the gas entry 29, into the inlet channel 31 and from the inlet channel through the inlet port 33 into the working chamber 36. The inlet port 33 is downstream of the inlet channel 31 in the pump head 15. The space of the entry area 26 is in fluid connection with the gas entry 29, inlet channel 31, and inlet port 33. The space of the entry 26 is preferably at least in fluid connection with the inlet channel 31 and preferably comprises at least part of the inlet channel 31. The inlet channel preferably comprises at least a portion of the space of the entry area 26. A portion of the space of the entry area 26 can comprise 254 an opening through an external surface of the pump head. The opening through the external surface is other than the gas entry 29 opening into the inlet channel 31 in the pump head 15. The inlet port 33 is in a cone 51. The cone 51 is a cone port having inlet port 33.

Alternatively the space of the entry area 26 can comprise the gas entry opening 29 which opens into the inlet channel 31 or the space of the entry area 26 can comprise an exit of the inlet channel. The space of the entry area 26 can more broadly comprise any space through which the sealing liquid passes before it enters interstices 37 in the working chamber 36 and surrounding areas to be sealed by the sealing liquid so long as the space of the entry area 26 is an area where the pressure Pi at this space is sufficiently less than the pressure Pd of the sealing liquid along the distal portion 21*b* of the flow path at and during startup to allow a sufficient volume of sealing liquid to flow into the entry area to effectively seal the interstices and otherwise properly operate the pump. It is believed an appropriate pressure differential is approximately from 2 psi to 5 psi. The space of the entry area 26 is preferably a void space. The sufficient pressure difference of approximately from 2 psi to 5 psi occurs without the aid of an extra pump at startup. The pressure difference occurs as a result of the orientation of the entry area and rotation of the rotor 39 which produces a gas suction, zero pressure, at the gas entry 29 and inlet channel 31 and a gas discharge, positive pressure, at the pump discharge outlet 13. The orientation includes the position of the entry area relative to other features of the pump package. The startup mode of operation can be considered to commence when the rotor shaft 41 of the liquid ring pump package 17 first begins to rotate until the rotor reaches its operating speed or rated speed or desired speed or the pressure or flow of the gas at the discharge outlet 13 is at its rated, desired or operating pressure or flow. At this speed, pressure or flow the pump package is in the running mode of operation.

The volume of sealing liquid passing along the entry area 26 during startup compared to the work done by the volume of gas entering the gas entry 29 during startup, the work done approximated by power consumed, should not exceed a ratio, sealing liquid to power consumed, of more than 0.3 GPM/HP. It should, however, be at least 0.1 GPM/HP to ensure sufficient sealing liquid flow to properly operate the pump; such as to allow, for example, proper filling of the interstices and lubrication. The abbreviation GPM is gallons per minute and the abbreviation HP is horse power. HP approximates power consumed. The volume of sealing liquid passing along the entry area 26 during the running mode compared to the work done by the volume of gas entering the gas entry 29 during the running mode should not exceed a ratio, sealing liquid to power consumed, of more than 0.75 GPM/HP. It should, however, be at least 0.2 GPM/HP to ensure sufficient sealing liquid flow to properly operate the pump; such as to allow, for example, proper filling of the interstices and lubrication. The volume of gas to work done by the pump in each case is measured in cubic feet per minute/HP. Surprisingly the performance of the compressor type liquid ring pump package 17 measured in terms of cubic feet per minute during the running mode over the entire operating pressure range decreases only 5% compared to having the entry area outside of the gas flow path 35*a*. For instance there is only a 5% decrease in efficiency as compared to having an entry area at the cone seal area 43. With respect to the startup mode there is only a 3-5 percent decrease in efficiency as compared to having an entry area at the cone seal area 43. To provide a vacuum at the space of the entry area 26 during startup a restrictor valve 45, (sometimes referred to as an inlet valve or an intake valve) can be used. The restrictor valve 45 is preferably proximate the gas entry 29 opening into the pump head inlet channel 31. It can be upstream or downstream of the gas entry 29. It is upstream of the exit of the inlet channel 31 and upstream of the inlet port 33. It is always upstream of the entry area 26. To provide the vacuum at the space of the entry area 26, at startup, the restrictor valve 45 would be in a restricted orientation. The restricted orientation allows less volume of gas to pass through the valve per unit of time than if the valve 45 is in an unrestricted orientation. Therefore during startup, if the valve 45 is in the restricted orientation a vacuum exists downstream of the valve 45. A vacuum exists at the entry area. The vacuum means a greater absolute pressure difference exists between the pressure Pi at the entry area 26 and the pressure Pd of the sealing liquid along the distal portion 21*b* than if the valve 45 is in the unrestricted orientation. The greater pressure difference increases the flow of sealing liquid passing into space of the entry area 26 from the proximate portion 21*a* of the sealing liquid flow path. Once the liquid ring pump package 17 enters into its running mode, such as for example, the rotor reaches its rated speed or the discharge at the discharge outlet 13 reaches its rated pressure or flow, the valve 45 is oriented into the unrestricted orientation. Even when the valve 45 is in the unrestricted orientation, the sealing liquid will continue to flow into the space of the entry area 26 at a sufficient volume per unit of time. The pressure Pi at the space is still sufficiently less than Pd at the distal portion 21*b* to allow for sufficient sealing liquid flow Pd in the running mode, compared to Pd during startup has increased.

The compressor type liquid ring pump package 17 can include a second entry area 49 and second sealing liquid flow path 47. The second sealing liquid flow path 47 is also in fluid connection with the sealing liquid reservoir 19, separator 11, and pump discharge outlet 13. The second sealing liquid flow path 47 is downstream of each of these items. The second entry area 49 is in a location of the pump different from a location of the first entry area 26. The second entry area 49 is outside of the space which the first entry area 26 comprises. The second entry area 49 is outside of the inlet channel 31 in the pump head 15. The second entry area 49 is also oriented outside of the space formed by the buckets and the liquid ring in the intake zone of the working chamber. The second entry is outside of the gas flow path 35*a*. The second entry area 49 and its space preferably comprise the cone seal area 43. The cone seal area is an area proximate where interstices exist between the cone 51 and shaft 41 at an end portion of the cone opposite its nose. The second entry area 49 is downstream of a proximate portion 47*a* of the second sealing liquid flow path 47. The proximate portion 47*a* is in fluid connection with the reservoir 19 but more proximate to the second entry area 49 than it is to the reservoir, the structure 27 connecting the reservoir 19, and the second sealing liquid flow path 47 as measured along the second sealing liquid flow path 47. A distal portion 47*b* of the second sealing liquid flow path is more proximate to the reservoir 19 and structure 27 than it is to the entry area 49. The proximate portion 47*a* is closer to the second entry area than the distal portion. The distal portion 47*b* is closer to the sealing liquid supply than the proximate portion 47*a*. The proximate portion 47*a* and distal portion 47*b* are in fluid connection with each other and upstream of the second entry area 49. The proximate portion is upstream of the distal portion. The sealing liquid supply can be the reservoir 19.

The second entry area 49 during startup is at a pressure Pii close to the pressure of the sealing liquid Pd2 along distal portion 47*b* of the second sealing liquid flow path 47. The pressure at said second entry area 49 is greater than said pressure at said first entry area 26 during startup. Also during startup, the pressure at the second entry area 49 is closer, in absolute terms, to the pressure of sealing liquid along the distal portion 47*b* of the second sealing liquid flow path 47 than the pressure at the first entry area 26 is to said pressure of sealing liquid along said distal portion 21*b* of the first sealing liquid flow path 21. The pressure Pii at the second area 49, however, during the running mode, is much less than the pressure Pd2 of the sealing liquid along the distal portion 47*b* of the second sealing liquid flow path. The pressure difference is sufficient to allow a sufficient volume of sealing liquid to flow into the second entry area to properly operate the pump during the running mode without the use of an extra pump. Proper operation includes filling the interstices and lubrication.

The second sealing liquid flow path 47 can share a common overlapping portion with the first flow path 21. In the shown embodiment, 21*b* and 47*b* are common. Alternatively the second flow path can be considered to simply be the portion 47*a* that branches off from the first flow path 21. In either case, the first and second flow paths are in flow connection with each other and at least one flow path is open to the other. Alternatively, the flow paths could be separate and do not overlap, and neither could open directly to the other. They would however each open to a common sealing liquid supply such as the reservoir 19. Alternatively, the common sealing liquid supply can be portions 21*a* and 47*a*. The first path could be just portion 21*a* and the second path could be just portion 47*a*. In all cases the first and second flow paths are in fluid connection.

If a second sealing liquid flow path 47 is used, a valve 53, in-line with and along said first flow path 21 is preferably used to close and seal a portion of the first sealing liquid flow path 21 and more preferably at least a portion of the proximate portion 21*a* to the first entry area 26. The valve is preferably, in a flow direction, between the first entry area 26 and the distal portion 21*b* of the first sealing liquid flow path. The valve is preferably upstream of where the first flow path 21*a* opens into a common sealing liquid supply 21*b*, 47*b* of the first 21*a* and second 47*a* flow paths. The valve 53 is preferably in fluid connection with the second sealing liquid flow path 47*a*. The valve has a first open orientation wherein the sealing liquid may flow along the proximate portion 21*a* and through the valve 53 into the first entry area 26. The valve has a second closed orientation wherein the valve 53 prevents sealing liquid from flowing along the proximate portion 21*a* and through the valve 53 into the first entry area 26. The valve 53 can be a solenoid valve responsive to operational characteristics such as discharge pressure, inlet pressure and/or operating speed of the motor or other prime mover driving the shaft. The valve would change between the closed and open orientation based on the operational characteristics. The valve can also be a mechanical type valve responsive to discharge pressure. The valve would change from an open to a closed orientation based on discharge pressure. For instance the mechanical valve 53 could be a check valve which closes when the pressure of the sealing liquid in the distal portion 21*b* sealing liquid flow path exceeds a predetermined pressure.

In addition to the above valve 53, a second valve 55 can be used in the package. The second valve 55 closes and seals off a portion of the second sealing liquid flow path 47 and preferably from a portion of the proximate portion 47*a* of the second sealing liquid flow path to the second entry area 49. The valve 55 is preferably, in a flow direction, between the second entry area and the distal portion 47*b* of the second sealing liquid flow path 47. The valve 55 is preferably upstream of where the second flow path 47*a* opens into a common sealing liquid supply 21*b*, 47*b* of the first and second flow paths. The valve 55 is preferably in fluid connection with the first sealing liquid flow path 21*a*. The valve 55 has a first open orientation wherein the sealing liquid may flow along the proximate portion 47*a* and through the valve 55 into the second entry area 49. The valve 55 has a second closed orientation wherein the valve 55 prevents sealing liquid from flowing along the proximate portion 47*a* and through the valve 55 into the second entry area 26. The valve can be a solenoid valve responsive to operational characteristics such as discharge pressure, inlet pressure and/or operating speed of the motor or other prime mover driving the shaft. The valve 55 would change between the closed and open orientation based on the operational characteristics. In general, the valve 55 would be open when the pressure of the sealing liquid in the distal portion 47*b* of the second sealing liquid flow path is sufficiently greater than the pressure in the second entry area 49 to allow for a sufficient flow of sealing liquid.

In operation, the pump shaft 41 in the startup mode begins to rotate about its axis. The rotor 39 begins to rotate about its axis which can be coextensive with the shaft axis. After the start of rotation of the shaft 41 and rotor 39, while still in the startup mode, such as after the elapse of at least 30-60 seconds from the start of rotation on small size compressors, 60-120 seconds on larger units, a sufficient pressure difference is established between the pressure Pi at the first entry 26 and the pressure Pd of the sealing liquid in the distal portion 21*b* of the first sealing liquid flow path. The pressure difference is sufficient when Pi is less than Pd in absolute terms to ensure sufficient flow of sealing liquid. The orientation of the entry 26 and the rotation of the rotor 39 create the sufficient pressure difference between Pi and Pd such that Pi is sufficiently less than Pd. The pressure in the inlet channel 31, for instance, as a result of the orientation and initial rotation is sufficiently less than Pd. The pressure Pi, is actually reduced by the rotation. The pressure Pi is preferably around zero Psi. The pressure difference is preferably from at least 3 psi to 5 psi to overcome pressure drops. As a result of the sufficient pressure difference, sealing liquid flows into the entry area 26. From the entry area 26, the sealing liquid flows into the interstices 37, such as the interstices between the cone and shaft at the cone seal area 43. The volume of sealing liquid passing along the entry area 26 at startup compared to work done by the volume of gas entering the gas entry 26, work done approximated by power consumed, is kept to a ratio of sealing liquid to power consumed is of no more than 0.3 GPM/HP. It should however be at least 0.1 GPM/HP to ensure sufficient sealing liquid flow to properly operate the pump, such as fill the interstices and provide lubrication. The pressure difference is obtained without the use of the extra pump such as having an extra pump in fluid connection with the first entry area 26 or the first sealing liquid flow path 21.

As the shaft 41 and rotor 39 continues to rotate, the pressure of Pd increases. After a period of time from the start of rotation such as at least 30-60 seconds on small compressors and about 60-120 seconds on large compressors, the pump package 17 is in its running mode of operation. In the running mode, the pump package 17 has reached its operating, desired or rated speed and its operating, desired, or rated discharge flow or pressure. In the running mode, the pressure Pd of the sealing liquid along the distal portion 21*b* of the first sealing liquid flow path 21 is still sufficiently greater than Pi at the first entry area 26. The pressure difference is at least 3 psi to 5 psi. Unless a second flow path 47 is used, the sealing liquid will continue to flow into the first entry area 26 during the running mode. The volume of sealing liquid passing along the entry area 26 during the running mode compared to work done by the volume of gas entering the gas entry and resulting power consumed is kept to a ratio of liquid volume to power consumed of no more than 0.75 GPM/HP. It should however be at least 0.2 GPM/HP to ensure sufficient sealing liquid flow.

In the embodiment having the second sealing liquid flow path 47, when the rotor 39 and shaft 41 first begin to rotate about their axis the pressure Pii at the second entry area 49, such as the cone seal area 43, is not sufficiently less than the pressure Pd2 in the distal portion 47*b* of the second sealing liquid flow path 47 to ensure sufficient flow. After the start of rotation of the shaft 41 and rotor 39, while in the startup mode, such as after the elapse of at least 30 seconds on small compressors and about 60 seconds on large compressors, from the start of rotation, the pressure Pii is still not sufficiently less than the pressure Pd2 of the sealing liquid in the distal portion 47*b* of the second sealing liquid flow path. After a period of time, from the start of rotation, such as at least 70 seconds on small compressors and about 140 seconds on large compressors, the pump package 17 is in its running mode. In the running mode, the pressure Pd2 of the sealing liquid along the distal portion 47*b* of the second sealing liquid flow path 47 is sufficiently greater than Pii at the second entry area 49 to allow sufficient flow. Sufficient flow as stated allows for proper operation of the pump such as the filling of interstices with the sealing liquid and lubrication of the pump. The rotation of the rotor 39 increases the pressure difference between Pii and Pd2 such that Pd2 is sufficiently greater than Pii to provide a sufficient pressure difference. As stated a sufficient pressure difference means a sufficient flow. Preferably, the valve 53 between the first entry area 26 and the distal portion 21*b* of the first sealing liquid flow path 21 is oriented to the closed orientation from an open orientation. The flow along the first sealing liquid introduction path 21 and in particular the proximate portion 21*a*, into the first entry area 26 is stopped. The flow along the second sealing liquid flow path 47, and in particular, along the proximate portion 47*a* of the second sealing liquid entry path 47 into the second entry area 49 starts and continues.

In an embodiment, the second valve 55 between the second entry 49 and the distal portion 47*b* of the second sealing flow path is placed in an open orientation from a closed orientation. The flow of liquid through the valve 55 into the second entry area 49 from the proximate portion 47*a* is permitted. Preferably the second valve 55 is placed in the open orientation at a time at or after the pump package 17 enters into its running mode of operation and also after the first valve 53 is placed in the closed orientation.

The operating radial clearance 57 between the cone 51 and the elongated lateral free edges 59 of the rotor 39 (clearance varies with pump size, operating pressure capabilities and lobe design single or double which controls shaft deflection) is maintained to at least 0.01 inches on small compressors, and could be as high as 0.05 inches on large compressors. The free edges of the rotor 39 extend in a direction along a length of the shaft and define a cavity 61 to receive the cone 51. The flowing of the sealing liquid into the first entry area and second area is done without the sealing liquid condensing a fluid in a gaseous state to a liquid state. The fluid that the sealing liquid avoids condensing is a fluid that has a liquid state at room temperature and preferably between 70 degree F. and 150 degree F.

The pump can have a working chamber housing 100 that has a circular inner surface 101 delimiting a circular working chamber. In this case the compressor package is a single lobe design having a single intake zone and compression zone. The pump could be a multiple lobe design. In this case the working chamber housing would have an oval inner surface delimiting an oval working chamber. The working chamber would have two intake zones and two compression zones in an alternating pattern. The two intake zones would be on opposite ends of the minor axis of the oval and the two compression zones would be on opposite ends of the major axis.

Figure 2:
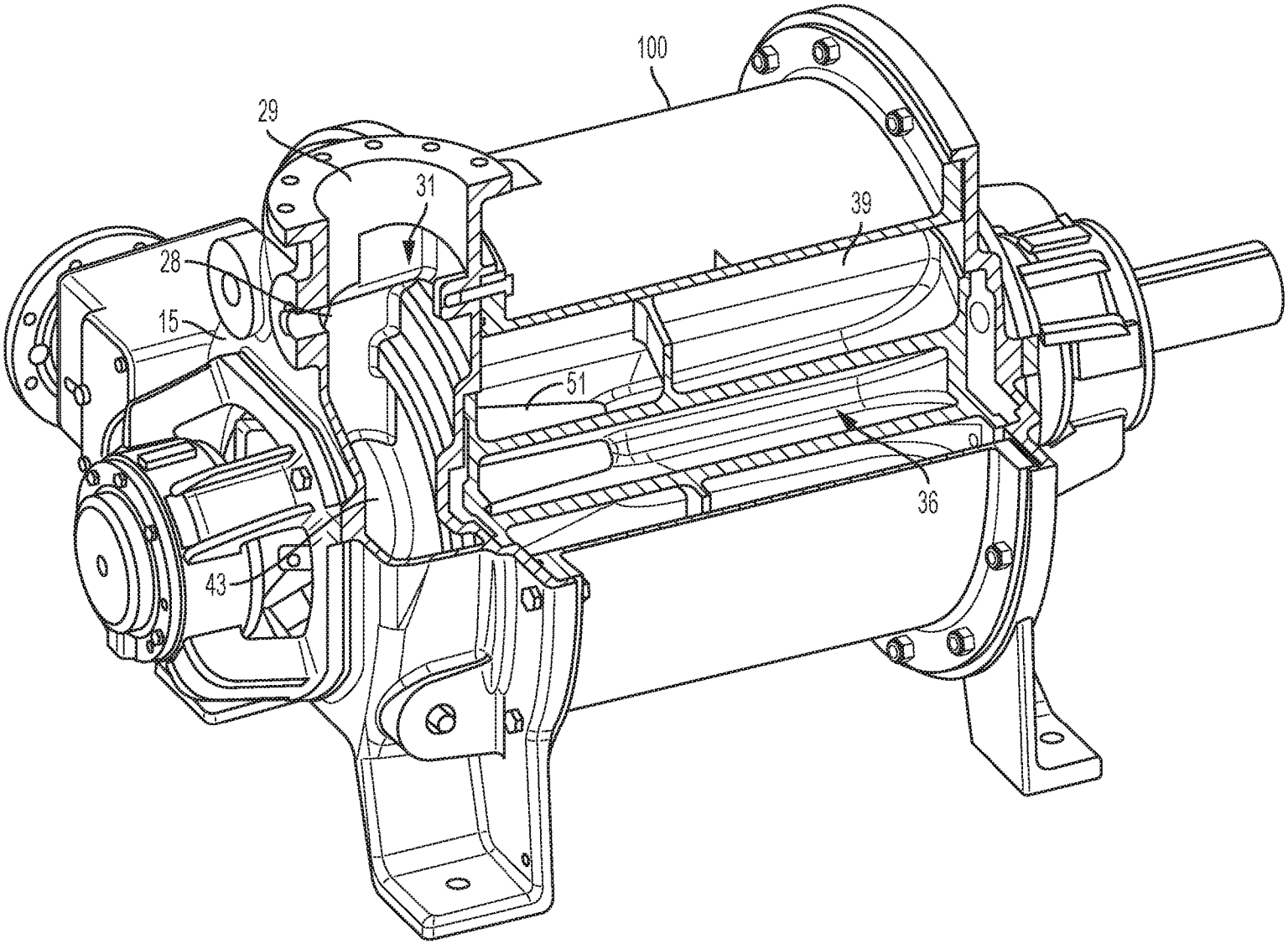
FIG. 2 is a cut-away side view of a liquid ring pump package embodying features of the present invention.

The liquid ring pump of FIGS. 1 and 2 is operable in a start-up mode or a normal operating mode (also referred to herein as the running mode of the pump). Typically, pumps of this type are used as air compressors and the operation of the pump will be described in that context. When the pump is not operating, the pressures within the various regions of the system tend to equalize at or near atmospheric pressure. Thus, the working chamber, the inlet channel, the outlet space, the cone seal area, and the separator including the reservoir tend to return to atmospheric pressure. When it is desirable to start the pump, there is no pressure differential present to move or force the movement of the sealing fluid contained within the reservoir. In prior art pumps, a separate pump might be provided for this function. However, in the illustrated construction, no additional pump is required.

To start the pump of FIGS. 1 and 2, the user initiates a start sequence by initiating rotation of the rotor. The rotor will draw air in through the intake channel as during the running mode. However, the intake valve is moved toward the closed position to throttle the air entering the inlet channel. Further rotation of the rotor thus causes a pressure reduction in the inlet channel as the rotor is capable of compressing or pumping more air than what can pass through the intake valve. The valve 53 located in the first sealing flow path is opened or opens in response to this reduced pressure to create an open fluid flow path between the reservoir and the intake channel. The pressure within the reservoir is still near atmospheric pressure (or slightly higher), thus establishing a pressure differential between the ends of the first fluid flow path that is sufficient to force sealing liquid into the inlet channel.

Once sufficient fluid is in the pump or the start-up sequence or mode is complete, the pump transitions to the running mode. To transition, the intake valve is moved to the open position and the valve in the first fluid flow path is closed (or closes in response to the increased pressure in the inlet channel). Rotation of the rotor during the start-up phase has resulted in a quantity of compressed air exiting the rotor at the outlet space. This compressed air increases the pressure in the outlet space and in the separator. Thus, the pressure in the reservoir has now increased to some value above atmospheric pressure. The pressure in the cone seal area is around atmospheric pressure (or slightly less). The second flow path provides fluid communication between the cone seal area and the reservoir with the aforementioned pressure differential providing the force needed to push sealing liquid from the reservoir into the cone seal area. The second valve, positioned in the second fluid flow path is either opened or opens in response to this pressure differential to assure the desired flow.

The term gas as use herein is broad enough to include, without limitation, ambient air, fluids in a gaseous state other than ambient air, mixtures of gases, other than ambient air, with ambient air and/or non-ambient gases, and mixtures of incompressible and compressible fluids, vaporized liquids mixed with ambient air, and also vaporized liquids. The phrase "smaller compressors" means no more than 50 HP. The term "larger compressor" means at least more than 50 HP.

What is claimed is:

1. A method of starting a liquid ring pump arranged to compress a gas, the liquid ring pump including a housing, a pump head, and an intake valve, the method comprising:

providing a first quantity of a sealing liquid in a reservoir, a pressure of the reservoir and a pressure of an inlet channel of the pump head being the same first pressure prior to the starting of the liquid ring pump, the pump head coupled to the housing and defining the inlet channel, an outlet space, and a cone seal area, the housing defining an interior working space sized to receive a quantity of the gas and a second quantity of the sealing liquid;

providing a first flow member coupled to the reservoir and the inlet channel to provide fluid communication therebetween;

providing a second flow member coupled to the reservoir and the cone seal area to provide fluid communication therebetween;

providing a first valve at a junction between the first flow member and the inlet channel, wherein the first valve automatically opens during a start-up mode of the liquid ring pump, and automatically closes during a running mode of the liquid ring pump that follows the start-up mode;

providing a second valve at a junction between the second flow member and the cone seal area, wherein the second valve automatically closes during the start-up mode and automatically opens during the running mode of the liquid ring pump;

providing a rotor supported for rotation by a shaft, the rotor disposed at least partially within the interior working space and operable to draw in the gas from the inlet channel at an inlet pressure and to discharge the gas to the outlet space at an outlet pressure that is higher than the inlet pressure;

moving the intake valve from an open position toward a closed position at a gas entry opening of the inlet channel to limit the quantity of the gas that can pass through the intake valve to a first quantity of the gas;

producing a partial vacuum in the inlet channel by initiating the start-up mode for the liquid ring pump, wherein the liquid ring pump is initially operable to pump more than the first quantity of the gas; and drawing the sealing liquid from the reservoir via the first flow member in response to a pressure differential created by the partial vacuum.

2. The method of claim 1, further comprising discharging a mixture of the gas in a compressed state and the sealing liquid to a pump discharge outlet, the outlet pressure at the pump discharge outlet being higher than the inlet pressure of the inlet channel at an end of the start-up mode, and increasing the pressure of the reservoir in response to the outlet pressure at the pump discharge outlet.

3. The method of claim 2, further comprising directing the sealing liquid to the liquid ring pump via the second flow member in response to the pressure of the reservoir exceeding a predetermined value.

4. The method of claim 3, further comprising moving the intake valve toward the open position to admit a second quantity of the gas into the liquid ring pump, the second quantity being greater than the first quantity.

5. The method of claim 1, further comprising flowing the sealing liquid into the inlet channel at a rate of no more than 0.75 gallons per minute (GPM per horse power (HP) of work done by a volume of gas entering the inlet channel.

6. A liquid ring pump arranged to compress a gas, comprising:

a housing defining an interior working space sized to receive a quantity of the gas and a first quantity of a sealing liquid;

a pump head coupled to the housing and defining an inlet channel, an outlet space, and a cone seal area;

an intake valve movable between an opened position and a closed position to control the quantity of the gas entering the inlet channel;

a reservoir containing a second quantity of the sealing liquid;

a first flow member coupled to the reservoir and the inlet channel to provide fluid communication therebetween;

a second flow member coupled to the reservoir and the cone seal area to provide fluid communication therebetween;

a rotor supported for rotation by a shaft, the rotor disposed at least partially within the interior working space and operable to draw in the gas from the inlet channel at an inlet pressure and to discharge the gas to the outlet space at an outlet pressure that is higher than the inlet pressure;

a first valve disposed at a junction between the first flow member and the inlet channel, wherein the first valve automatically opens during a start-up mode of the liquid ring pump and automatically closes during a running mode of the liquid ring pump that follows the start-up mode; and a second valve disposed at a junction between the second flow member and the cone seal area, wherein the second valve automatically closes during the start-up mode and automatically opens during the running mode of the liquid ring pump.

7. The liquid ring pump of claim 6, wherein the inlet channel, the outlet space, and the cone seal area are separate from one another.

8. The liquid ring pump of claim 6, wherein the first valve is a check valve, the second valve is a check valve, or the first valve and the second valve are both check valves.

9. The liquid ring pump of claim 6, wherein during the start-up mode, rotation of the rotor produces a lower pressure region in the inlet channel with respect to a reservoir pressure, and wherein the sealing liquid is drawn into the inlet channel at least partially in response to a difference between the lower pressure region and the reservoir pressure.

10. The liquid ring pump of claim 6, further comprising a discharge flow path that fluidly connects the outlet space to a separator operable to separate the gas and the sealing liquid, and wherein the reservoir is formed as part of the separator.

11. The liquid ring pump of claim 10, wherein during the running mode, rotation of the rotor increases a reservoir pressure within the reservoir so that the reservoir pressure is greater than a pressure within the cone seal area, and wherein the sealing liquid flows from the reservoir to the cone seal area at least partially in response to a difference in pressure between the reservoir pressure and the pressure within the cone seal area.

12. The liquid ring pump of claim 6, wherein the second flow member is coupled directly to the reservoir and the first flow member is coupled to the reservoir via the second flow member.

13. The liquid ring pump of claim 6, wherein the first valve, the second valve, or both the first valve and the second valve comprise an electronic valve programmed to automatically respond to operational characteristics of the liquid ring pump.

14. A liquid ring pump arranged to compress a gas, comprising:

a housing defining an interior working space sized to receive a quantity of the gas and a first quantity of a sealing liquid;

a pump head coupled to the housing and defining an inlet channel, an outlet space, and a cone seal area;

an intake valve movable between an opened position and a closed position to control the quantity of the gas entering the inlet channel;

a reservoir containing a second quantity of the sealing liquid;

a pump discharge path providing fluid communication between the outlet space and the reservoir;

a first flow member coupled to the reservoir and the inlet channel to provide fluid communication therebetween;

a second flow member coupled to the reservoir and the cone seal area to provide fluid communication therebetween;

a first valve disposed at a junction between the first flow member and the inlet channel, wherein the first valve automatically opens during a start-up mode of the liquid ring pump, and automatically closes during a running mode of the liquid ring pump that follows the start-up mode;

a second valve disposed at a junction between the second flow member and the cone seal area, wherein the second valve automatically closes during the start-up mode and automatically opens during the running mode of the liquid ring pump; and a rotor supported for rotation by a shaft, the rotor disposed at least partially within the interior working space, the liquid ring pump operable in the start-up mode to draw the sealing liquid into the interior working space via only the first flow member, and during the running mode to draw the sealing liquid into the interior working space via only the second flow member.

15. The liquid ring pump of claim 14, wherein the first valve is a check valve, the second valve is a check valve, or the first valve and the second valve are both check valves.

16. The liquid ring pump of claim 14, wherein during start-up operation, rotation of the rotor produces a lower pressure region in the inlet channel with respect to a reservoir pressure, and wherein the sealing liquid is drawn into the inlet channel at least partially in response to a difference between the lower pressure region and the reservoir pressure.

17. The liquid ring pump of claim 14, wherein the reservoir is formed within a separator operable to separate the gas and the sealing liquid, and the pump discharge path fluidly connects the outlet space to the separator.

18. The liquid ring pump of claim 14, wherein during running mode, rotation of the rotor increases a reservoir pressure within the reservoir so that the reservoir pressure is greater than a cone seal area pressure within the cone seal area, and wherein the sealing liquid flows from the reservoir to the cone seal area at least partially in response to a difference in pressure between the reservoir pressure and the cone seal area pressure.

19. The liquid ring pump of claim 14, wherein the second flow member is coupled directly to the reservoir and the first flow member is coupled to the reservoir via the second flow member.

20. A method of providing a sealing liquid to a liquid ring pump that is operable in a start-up mode and a running mode, the method comprising:

providing a reservoir containing a quantity of the sealing liquid, a pump head inlet channel, and an outlet space each at atmospheric pressure prior to initiating operation in the start-up mode;

initiating the start-up mode;

throttling, via an intake valve, a flow of a gas into the pump head inlet channel to produce a lower pressure region therein with respect a pressure within the reservoir during the start-up mode;

drawing the sealing liquid into the pump head inlet channel through a first flow path and a first valve in response to the lower pressure region in the pump head inlet channel, wherein the first valve is disposed at a junction between the first flow path and the pump head inlet channel, and the first valve automatically opens during the start-up mode;

increasing via a rotor, a pressure within the outlet space and the pressure within the reservoir in response to operation in the start-up mode;

reducing the throttling of the flow of the gas into the pump head inlet channel to transition to the running mode, wherein a throttle reduction automatically closes the first valve in the first flow path to prevent the flow of the sealing liquid into the pump head inlet channel via the first flow path; and automatically opening a second valve in a second flow path to direct the sealing liquid into the liquid ring pump in response to the increased pressure within the reservoir, wherein the second valve is disposed at a junction between the second flow path and a cone seal area of the liquid ring pump, automatically closes during the start-up mode, and automatically opens during the running mode.

* * * * *